United States Patent [19]

Shebuski

[11] Patent Number: 4,565,227

[45] Date of Patent: Jan. 21, 1986

[54] PROCESS AND APPARATUS FOR SURROUNDING FOAM PATTERN WITH SAND

[75] Inventor: Robert C. Shebuski, Hubertus, Wis.

[73] Assignee: Outboard Marine Corporation, Waukegan, Ill.

[21] Appl. No.: 621,117

[22] Filed: Jun. 15, 1984

[51] Int. Cl.[4] ..... B65B 1/04

[52] U.S. Cl. ..... 141/1; 141/98

[58] Field of Search ..... 141/1-12, 141/37-67, 129-191, 250-284, 285-310, 369-381, 98

[56] References Cited

U.S. PATENT DOCUMENTS

| | | | |
|---|---|---|---|
| 523,392 | 7/1894 | Wuelfing | 141/374 |
| 1,433,663 | 10/1922 | Small | 141/368 |
| 2,283,093 | 5/1942 | Rosenthal et al. | 141/311 R |
| 3,967,659 | 7/1976 | Warner et al. | 141/79 |
| 3,967,662 | 7/1976 | Warner | 141/148 |

*Primary Examiner*—Houston S. Bell, Jr.

*Attorney, Agent, or Firm*—Michael, Best & Friedrich

[57] ABSTRACT

A process and apparatus for surrounding a mold pattern with sand, the mold pattern including an inner cavity having a bottom. The process comprises the steps of holding the mold pattern in a mold flask, and depositing sand into the mold flask outside the mold pattern and into the inner cavity of the mold pattern such that, when the level of the sand outside the mold pattern is adjacent the level of the bottom of the inner cavity, the levels of the sand inside the inner cavity and outside the mold pattern are maintained the same as the mold flask is filled with sand.

8 Claims, 3 Drawing Figures

PROCESS AND APPARATUS FOR SURROUNDING FOAM PATTERN WITH SAND

BACKGROUND OF THE INVENTION

The invention relates to processes and apparatus for surrounding foam mold patterns with sand.

Various methods are known for surrounding a foam mold pattern in a mold flask with sand. Such methods include (a) depositing sand relatively uniformly across the mold flask, such as through a screen, (b) inserting tubes into the corners of the mold flask and releasing sand through the tubes into the mold flask, (c) inserting the foam pattern into a mold flask of fluidized sand, and (d) manually filling the mold flask.

Manually filling the mold flask is undesirable for obvious reasons. Inserting the foam pattern into fluidized sand often causes distortion of the foam pattern due to insertion forces and the large amount of sand settling that takes place when the fluidizing is discontinued. This method also requires expensive equipment for fluidizing sand. The other two methods are generally acceptable, except that they present problems when the foam mold pattern is thin walled and has an inner cavity. In such a case, when the tube method is used, the mold flask fills with sand outside the foam pattern before the inner cavity fills with sand. Therefore, before the inner cavity fills with sand, a pressure gradient forms across the wall of the foam pattern. The result is a large exterior force on the foam pattern, which might distort or crush the pattern.

When the screen or even distribution method is used, the mold flask outside of the foam pattern and the inner cavity fill at the same time. However, if the walls of the foam pattern around the inner cavity are not substantially vertical so that the inner cavity of the foam pattern fills more slowly or more quickly than the mold flask outside the foam pattern, such as in the case of a hollow cone, a pressure gradient will still form across the wall of the foam pattern.

Attention is directed to the following U.S. patents: Wuelfing U.S. Pat. No. 523,392, issued July 24, 1894; Small U.S. Pat. No. 1,433,663, issued Oct. 31, 1922; Rosenthal U.S. Pat. No. 2,283,093, issued May 12, 1942; and Warner U.S. Pat. No. 3,967,662, issued July 6, 1976.

SUMMARY OF THE INVENTION

The invention provides a process for surrounding a mold pattern with sand, the mold pattern including an inner cavity having a bottom, the process comprising the steps of holding the mold pattern in a mold flask, and selectively depositing sand into the mold flask outside the mold pattern and inside the inner cavity of the mold pattern such that, when the level of the sand outside the mold pattern reaches the level of the bottom of the inner cavity, thereafter the levels of the sand inside the inner cavity and outside the mold pattern are maintained the same as the mold flask is filled with sand.

In one embodiment, the step of depositing sand includes the steps of lowering a first generally vertical tube having top and bottom ends into the mold flask outside the mold pattern such that the bottom end is below the bottom of the inner cavity, releasing sand into the top end of the first tube, and raising the first tube at a certain rate, and lowering a second generally vertical tube having top and bottom ends inside the inner cavity such that the bottom end of the second tube is adjacent the bottom of the inner cavity, releasing sand into the top end of the second tube, and, when the bottom end of the first tube is adjacent the bottom end of the second tube, raising the second tube at the same rate as that at which the first tube is raised.

In one embodiment, the step of depositing sand includes the steps of lowering the bottom end of a first tube having top and bottom ends into the mold flask outside the mold pattern such that the bottom end is below the bottom of the inner cavity, releasing sand into the top end of the first tube, and raising the bottom end of the first tube at a certain rate, and lowering the bottom end of a second tube having top and bottom ends inside the inner cavity such that the bottom end of the second tube is adjacent the bottom of the inner cavity, releasing sand into the top end of the second tube, and, when the bottom end of the first tube is adjacent the bottom end of the second tube, raising the bottom end of the second tube at the same rate as that at which the first tube is raised.

In one embodiment, the step of depositing sand includes the step of lowering the bottom end of a first tube having top and bottom ends into the mold flask outside the mold pattern such that the bottom end is adjacent the bottom of the inner cavity, releasing sand into the top end of the first tube, and raising the bottom end of the first tube at a certain rate. The depositing step also includes the step of lowering the bottom end of a second tube having top and bottom ends inside the inner cavity such that the bottom end of the second tube is adjacent the bottom of the inner cavity, releasing sand into the top end of the second tube, and raising the bottom end of the second tube at the same rate as that at which the first tube is raised.

In one embodiment, the step of depositing sand includes the step of lowering a first generally vertical tube having top and bottom ends into the mold flask outside the mold pattern such that the bottom end is adjacent the bottom of the inner cavity, releasing sand into the top end of the first tube, and raising the first tube at a certain rate. The depositing step also includes the step of lowering a second generally vertical tube having top and bottom ends inside the inner cavity such that the bottom end of the second tube is adjacent the bottom of the inner cavity, releasing sand into the top end of the second tube, and raising the second tube at the same rate as that at which the first tube is raised.

The invention also provides an apparatus for surrounding a mold pattern in a mold flask with sand, the mold pattern including an inner cavity having a bottom, the apparatus comprising a source of sand and means for depositing sand from the source of sand into the mold flask outside the mold pattern and into the inner cavity of the mold pattern such that, when the level of the sand outside the mold pattern reaches the level of the bottom of the inner cavity, the levels of the sand inside the inner cavity and outside the mold pattern are maintained the same as the mold flask is filled with sand.

In one embodiment, the means for depositing includes a first tube having a top end connected to said source of sand and a bottom end adapted to be lowered into the mold flask, a second tube having a top end connected to said source of sand and adapted to be lowered into the inner cavity of the mold pattern, means for selectively releasing sand from the source of sand into the top ends of the first and second tubes, and means for selectively raising and lowering the bottom ends of the first and second tubes.

In one embodiment, the first and second tubes are generally vertical, and the means for selectively raising and lowering includes means for raising and lowering the source of sand and the first and second tubes.

A principal feature of the invention is that is provides an apparatus for surrounding a thin walled mold pattern having an inner cavity with sand so that the mold pattern is not distorted or crushed.

Other features and advantages of the invention will become apparent to those skilled in the art upon review of the following detailed description, drawings, and claims.

Figure 1:
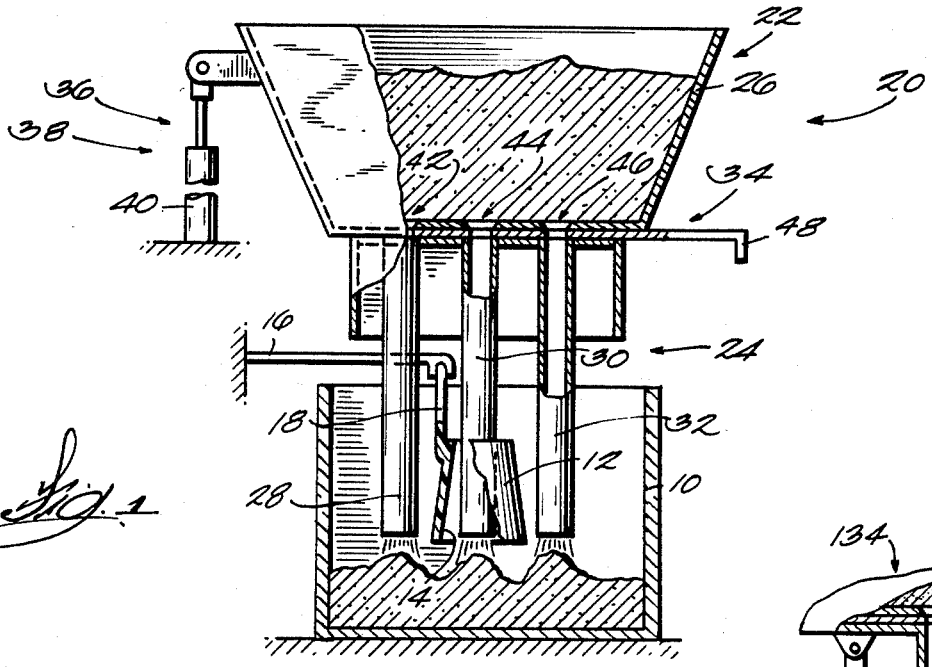
FIG. 1 is a side view, partially in cross-section, of an apparatus embodying the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is a mold flask 10 partially filled with sand and a mold pattern 12 including an inner cavity 14. The illustrated inner cavity 14 has an open bottom, but it should be understood that the invention is also applicable to mold patterns having inner cavities with closed bottoms.

Also shown in FIG. 1 is a support arm 16 clampingly engaging the sprue 18 of the mold pattern 12 to hold the mold pattern 12 in the mold flask 10, and an apparatus 20 for surrounding the mold pattern 12 with sand. The apparatus 20 comprises a source of sand 22 and means 24 for selectively depositing sand from the source of sand 22 into the mold flask 10 outside the mold pattern 12 and inside the inner cavity 14 of the mold pattern 12 such that, when the level of the sand outside the mold pattern 12 is adjacent the level of the bottom of the inner cavity 14, thereafter the levels of the sand inside the inner cavity 14 and outside the mold pattern 12 are maintained the same as the mold flask 10 is filled with sand.

While various suitable sources of sand could be employed, in the illustrated construction, the source of sand 22 is a conventional batch hopper 26 positioned above the mold flask 10.

While various suitable means for depositing sand in the above described manner could be employed, in the illustrated construction, the means 24 includes tubes 28, 30, and 32 having top ends connected to the batch hopper 26 and bottom ends adapted to be lowered into the mold flask 10. The tube 30 is further adapted to be lowered inside the inner cavity 14 of the mold pattern 12.

The means 24 also includes, in the preferred embodiment, means 36 for selectively raising and lowering the bottom ends of the tubes 28, 30, and 32. In the preferred embodiment, as illustrated in FIG. 1, the tubes 28, 30, and 32 are generally vertical and of substantially equal length, and the means 36 for selectively raising and lowering the bottom ends of the tubes 28, 30, and 32 includes means 38 for raising and lowering the batch hopper 26 and the tubes 28, 30, and 32. Although any suitable means could be used, the means 38 is illustrated schematically in FIG. 1 as a hydraulic cylinder-piston assembly 40 operably connected to the batch hopper 26 for selectively rectilinearly raising and lowering the batch hopper 26 and the connected tubes 28, 30, and 32.

It should be understood that the means 36 can alternatively be such that the bottom ends of the tubes 28, 30, and 32 are raised and lowered independently of each other, rather than such that the bottom ends of the tubes 28, 30, and 32 are raised and lowered together and are always at the same level, as in the preferred embodiment.

Figure 4:
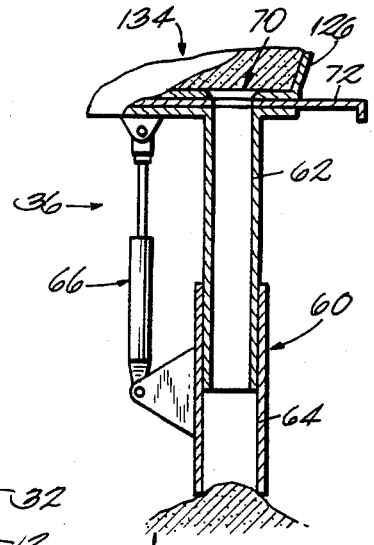
FIG. 4 is a side view, partially in cross-section, of an alternative construction of the apparatus.

Illustrated in FIG. 4 is an alternative embodiment of the means 36 for selectively raising and lowering the bottom ends of the tubes. In this embodiment, the tubes are raised and lowered independently of each other. Each of the tubes is a telescoping tube 60 including a top end 62 connected to the batch hopper 126 and a bottom end 64 slidably mounted on the top end 62 for upward and downward movement. Connected between the batch hopper 126 and the bottom end 64 of the tube 60 is a hydraulic cylinder-piston assembly 66 for selectively raising and lowering the bottom end 64 of the tube 60.

Returning to the preferred embodiment shown in FIG. 1, the means 24 also includes means 34 for selectively releasing sand from the batch hopper 26 into the top ends of the tubes 28, 30, and 32. While various suitable means 34 for selectively releasing sand from the batch hopper 26 into the top end of the tubes 28, 30, and 32 could be employed, in the preferred embodiment, the means 34 includes holes 42, 44, and 46 in the bottom of the batch hopper 26 and communicating with the top ends of the tubes 28, 30, and 32, respectively, and a sliding door 48 in the bottom of the batch hopper 26 and having openings that can be aligned with the holes 42, 44, and 46. The sliding door 48 is selectively movable between an open position wherein the openings are aligned with the holes 42, 44, and 46 and sand flows from the batch hopper 26 into the tubes 28, 30, and 32, and a closed position wherein the sliding door 48 closes the holes 42, 44, and 46. In FIG. 1, the sliding door 48 is shown in the open position.

Also illustrated in FIG. 4 is an alternative construction of the means 34 for selectively releasing sand from the batch hopper into the top end of the tubes. In this construction, there is separate means 134 for each tube 60 for releasing sand into the top end 62 of the tube 60. The means 134 includes a hole 70 in the bottom of the batch hopper 126 and communicating with the top end 62 of the tube 60, and a sliding door 72 in the bottom of the batch hopper 126 and having an opening that can be aligned with the hole 70.

The operation of the apparatus 20, and the preferred manner for carrying out the method of the invention, is as follows. The mold pattern 12 is held in the mold flask 10 by the support arm 16, and sand is deposited into the mold flask 10 up to the level of the bottom of the inner cavity 14. This is done, in the preferred embodiment, by lowering the tubes 28, 30, and 32 to approximately the level of the bottom of the inner cavity 14, and then releasing sand through the tubes 28, 30, and 32 into the mold flask 10 as shown in FIG. 1, until the sand reaches the level of the bottom of the inner cavity 14, as shown in FIG. 2.

Sand can also be deposited up to the level of the bottom of the inner cavity 14 by lowering the tubes 28, 30, and 32 to the bottom of the mold flask 10, assuming the inner cavity of the mold pattern has an open bottom as illustrated, and then raising the rubes 28, 30, and 32 to the level of the bottom of the inner cavity 14 while releasing sand through the tubes 28, 30, and 32.

In an alternative embodiment of the apparatus 20 including tubes that can be raised and lowered independently of each other, as shown in FIG. 4, the mold flask can be filled to the level of the bottom of the inner cavity by lowering the bottom ends of the outside tubes to the bottom of the mold flask while lowering the bottom end of the middle tube only to the bottom of the inner cavity. (Note that if the bottom of the inner cavity is closed, the middle tube cannot be lowered beyond that point.) The outside tubes are then raised, while sand is released through them, to the level of the bottom of the inner cavity, thereby filling the mold flask with sand up to that level. If the inner cavity has a closed bottom, sand need not be released into the middle tube during this part of the process.

Figure 2:
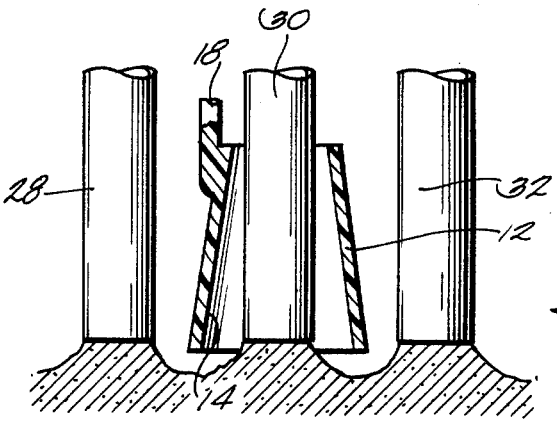
FIG. 2 is an enlarged view, partially in cross-section, of a portion of the apparatus of FIG. 1 wherein the sand being released through the tubes is at a level adjacent the bottom of the inner cavity of the mold pattern.
Figure 3:
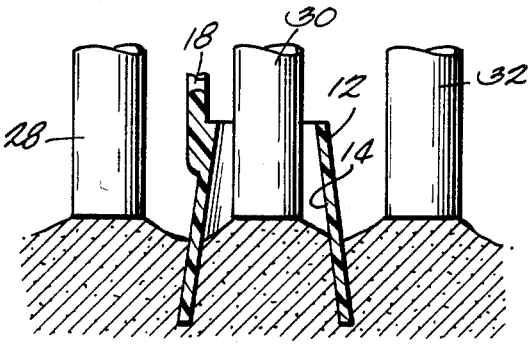
FIG. 3 is a view of the portion of the apparatus shown in FIG. 2 wherein the level of the sand being released through the tubes is above the bottom of the inner cavity.

With the mold pattern 12 supported in the mold flask 10, and with sand filling the mold flask 10 up to the level of the bottom of the inner cavity 14, as shown in FIG. 2, the bottom ends of the tubes 28, 30, and 32 are then raised above the level of the bottom of the inner cavity 14 at the same rate. In the preferred embodiment, this is done by raising the batch hopper 26 and the connected tubes 28, 30, and 32.

As the tubes 28, 30, and 32 are raised, sand flows out of the bottom ends and fills the mold flask 10 up to the level of the bottom ends of the tubes 28, 30, and 32. Regardless of the area to be filled by a given tube, the level of the sand in that area cannot rise above the bottom end of the tube. Therefore, the level of the sand inside the inner cavity 14 will be substantially the same as the level of the sand outside the mold pattern 12.

When the bottom ends of the tubes 28, 30, and 32 reach the top of the inner cavity 14, the mold flask 10 will have been filled with sand to the top of the mold pattern 12 without forming any significant pressure gradient across the walls of the mold pattern 12. The mold flask 10 can then be filled with sand to the desired level above the top of the mold pattern 12.

Various of the features of the invention are set forth in the following claims.

I claim:

1. A process for surrounding a mold pattern with sand, the mold pattern including an inner cavity having a bottom, said process comprising the steps of holding the mold pattern in a mold flask, and selectively depositing sand into the mold flask outside the mold pattern and inside the inner cavity of the mold pattern such that, when the level of the sand outside the mold pattern is adjacent the level of the bottom of the inner cavity, thereafter the levels of the sand inside the inner cavity and outside the mold pattern are maintained the same as the mold flask is filled with sand.

2. A process as set forth in claim 1 wherein said step of depositing sand includes the steps of lowering the bottom end of a first tube having top and bottom ends into the mold flask outside the mold pattern such that the bottom end is below the bottom of the inner cavity, releasing sand into the top end of the first tube, and raising the bottom end of the first tube at a certain rate, and lowering the bottom end of a second tube having top and bottom ends inside the inner cavity such that the bottom end of the second tube is adjacent the bottom of the inner cavity, releasing sand into the top end of the second tube, and, when the bottom end of the first tube is adjacent the bottom end of the second tube, raising the bottom end of the second tube at the same rate as that at which the first tube is raised.

3. A process as set forth in claim 1 wherein said step of depositing sand includes the steps of lowering a first generally vertical tube having top and bottom ends into the mold flask outside the mold pattern such that the bottom end is below the bottom of the inner cavity, releasing sand into the top end of the first tube, and raising the first tube at a certain rate, and lowering a second generally vertical tube having top and bottom ends inside the inner cavity such that the bottom end of the second tube is adjacent the bottom of the inner cavity, releasing sand into the top end of the second tube, and, when the bottom end of the first tube is adjacent the bottom end of the second tube, raising the second tube at the same rate as that at which the first tube is raised.

4. A process as set forth in claim 1 wherein said step of depositing sand includes the steps of lowering the bottom end of a first tube having top and bottom ends into the mold flask outside the mold pattern such that the bottom end is adjacent the bottom of the inner cavity, releasing sand into the top end of the first tube, and raising the bottom end of the first tube at a certain rate, and lowering the bottom end of a second tube having top and bottom ends inside the inner cavity such that the bottom end of the second tube is adjacent the bottom of the inner cavity, releasing sand into the top end of the second tube, and raising the bottom end of the second tube at the same rate as that at which the first tube is raised.

5. A process as set forth in claim 1 wherein said step of depositing sand includes the steps of lowering a first generally vertical tube having top and bottom ends into the mold flask outside the mold pattern such that the bottom end is adjacent the bottom of the inner cavity, releasing sand into the top end of the first tube, and raising the first tube at a certain rate, and lowering a second generally vertical tube having top and bottom ends inside the inner cavity such that the bottom end of the second tube is adjacent the bottom of the inner cavity, releasing sand into the top end of the second tube, and raising the second tube at the same rate as that at which the first tube is raised.

6. An apparatus for surrounding a mold pattern in a mold flask with sand, the mold pattern including an inner cavity having a bottom, said apparatus comprising a source of sand, and means for depositing sand from said source of sand into the mold flask outside the mold pattern and into the inner cavity of the mold pattern such that, when the level of the sand outside the mold pattern is adjacent the level of the bottom of the inner cavity, the levels of the sand inside the inner cavity and outside the mold pattern are maintained the same as the mold flask is filled with sand.

7. An apparatus as set forth in claim 6 wherein said means for depositing includes a first tube having a top end connected to said source of sand and a bottom end adapted to be lowered into the mold flask, a second tube having a top end connected to said source of sand and a bottom end adapted to be lowered into the inner cavity of the mold pattern, means for selectively releasing sand from said source of sand into said top ends of said first and second tubes, and means for selectively raising and lowering said bottom ends of said first and second tubes.

8. An apparatus as set forth in claim 7 wherein said first and second tubes are generally vertical, and wherein said means for selectively raising and lowering includes means for raising and lowering said source of sand and said first and second tubes.

* * * * *